US007992401B2

(12) United States Patent
Higashiyama

(10) Patent No.: US 7,992,401 B2
(45) Date of Patent: Aug. 9, 2011

(54) EVAPORATOR

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 1257 days.

(21) Appl. No.: 11/631,384

(22) PCT Filed: Jun. 29, 2005

(86) PCT No.: PCT/JP2005/012435

§ 371 (c)(1),
(2), (4) Date: Dec. 29, 2006

(87) PCT Pub. No.: WO2006/004137

PCT Pub. Date: Jan. 12, 2006

(65) Prior Publication Data

US 2008/0302131 A1 Dec. 11, 2008

Related U.S. Application Data

(60) Provisional application No. 60/585,839, filed on Jul. 8, 2004, provisional application No. 60/688,352, filed on Jun. 8, 2005.

(30) Foreign Application Priority Data

Jul. 5, 2004 (JP) ..... 2004-197959
Nov. 17, 2004 (JP) ..... 2004-332644

(51) Int. Cl.
*B60H 1/32* (2006.01)
*F25B 39/02* (2006.01)
*F28F 1/32* (2006.01)

(52) U.S. Cl. ..... 62/244; 62/515; 62/525; 62/272; 62/285; 62/288; 165/152; 165/153; 165/174; 165/176

(58) Field of Classification Search ..... 165/148–153, 165/173–176, 913; 62/525, 288, 285, 272, 62/244, 515
See application file for complete search history.

(56) References Cited

U.S. PATENT DOCUMENTS 3,298,432 A * 1/1967 Przyborowski ..... 165/153
4,311,193 A * 1/1982 Verhaeghe et al. ..... 165/149
4,328,861 A * 5/1982 Cheong et al. ..... 165/151
(Continued)

FOREIGN PATENT DOCUMENTS

JP 2000-179988 6/2000
JP 2003-75024 3/2003

OTHER PUBLICATIONS

U.S. Appl. No. 10/588,774, filed Aug. 8, 2006, Ichiyanagi et al.

*Primary Examiner* — John K Ford
(74) *Attorney, Agent, or Firm* — Oblon, Spivak, McClelland, Maier & Neustadt, L.L.P.

(57) ABSTRACT

An evaporator includes a plurality of flat heat exchange tubes arranged in a left-right direction at a spacing with the widthwise direction thereof pointing forward or rearward, and fins arranged between respective adjacent pairs of heat exchange tubes. The fins have at least front edges thereof projected forwardly outward beyond the heat exchange tubes. Assuming that the amount of projection of the fins beyond the heat exchange tubes is X mm and that the heat exchange tubes are Y mm in thickness in the left-right direction, i.e., in height, X and Y have the relationship of $0.11Y \leqq X \leqq 1.0Y$. The surfaces of the fins can be drained of condensation water efficiently.

13 Claims, 10 Drawing Sheets

U.S. PATENT DOCUMENTS 4,693,307 A * 9/1987 Scarselletta ..... 165/152
5,289,874 A * 3/1994 Kadle et al. ..... 165/152
5,979,051 A * 11/1999 Kato et al. ..... 29/890.049
6,095,239 A * 8/2000 Makino et al. ..... 165/140
6,273,184 B1 * 8/2001 Nishishita ..... 165/140
6,308,527 B1 * 10/2001 Kuroyanagi et al. ..... 62/288
6,561,264 B2 * 5/2003 Ozaki et al. ..... 165/140
6,964,296 B2 * 11/2005 Memory et al. ..... 165/151

* cited by examiner

EVAPORATOR

CROSS REFERENCE TO RELATED APPLICATION

This application is an application filed under 35 U.S.C. §111(a) claiming the benefit pursuant to 35 U.S.C. §119(e)(1) of the filing dates of Provisional Application No. 60/585,839 and No. 60/688,352 filed Jul. 8, 2004 and Jun. 8, 2005, respectively, pursuant to 35 U.S.C. §111(b).

TECHNICAL FIELD

The present invention relates to evaporators to be incorporated into motor vehicle air conditioners which are refrigeration cycles for use in motor vehicles.

The downstream side (the direction indicated by the arrow X in FIGS. 1, 3 and 6) of the flow of air to be passed through air passage clearances between respective adjacent pairs of heat exchange tubes of the evaporator will be referred to herein and in the appended claims as "front," and the opposite side as "rear." Further the upper, lower, left and right sides of the evaporator as it is seen from behind toward the front (the upper and lower sides and the left- and right-hand sides of FIG. 2) will be referred to as "upper," "lower," "left" and "right," respectively.

BACKGROUND ART

Heretofore in wide use as motor vehicle air conditioner evaporators are those of the so-called stacked plate type which comprise a plurality of flat hollow bodies arranged in parallel and each composed of a pair of dishlike plates facing toward each other and brazed to each other along peripheral edges thereof, and a louvered corrugated fin disposed between and brazed to each adjacent pair of flat hollow bodies. In recent years, however, it has been demanded to provide evaporators further reduced in size and weight and exhibiting higher performance.

To meet such a demand, the present applicant has already proposed an evaporator which comprise a heat exchange core composed of tube groups in the form of two rows arranged in parallel in the front-rear direction and each comprising a plurality of heat exchange tubes arranged at a spacing, a refrigerant inlet-outlet tank disposed at the upper end of the heat exchange core and a refrigerant turn tank disposed at the lower end of the heat exchange core, the refrigerant inlet-outlet tank having its interior divided by a partition into a refrigerant inlet header positioned on the front side and a refrigerant outlet header positioned on the rear side, the inlet header being provided with a refrigerant inlet at one end thereof, the outlet header being provided with a refrigerant outlet at one end thereof alongside the inlet, the refrigerant turn tank having its interior divided by a partition wall into a refrigerant inflow header positioned on the front side and a refrigerant outflow header positioned on the rear side, the partition wall of the refrigerant turn tank having a plurality of refrigerant passing holes formed therein and arranged longitudinally of the wall at a spacing, the heat exchange tubes of the front tube group having upper ends joined to the inlet header, the heat exchange tubes of the rear tube group having upper ends joined to the outlet header, the heat exchange tubes of the front tube group having lower ends joined to the inflow header, the heat exchange tubes of the rear tube group having lower ends joined to the outflow header. The refrigerant flowing into the inlet header of the inlet-outlet tank flows through the heat exchange tubes of the front tube group into the inflow header of the turn tank, then flows into the outflow header through the refrigerant passing holes in the partition wall and further flows into the outlet header of the inlet-outlet tank through the heat exchange tubes of the rear tube group (see the publication of JP-A NO. 2003-75024).

The evaporator disclosed in the above publication is reduced in weight and improved in performance, so that larger quantities of condensation water are produced over the surfaces of corrugated fins than in conventional evaporators of the stacked plate type, hence a larger amount of condensation water per unit volume of the evaporator. Consequently, the condensation water is likely to scatter about or freeze on the surfaces of corrugated fins to result in an impaired heat exchange efficiency. With evaporators, the condensation water produced on the surfaces of fins usually falls through the clearances between louvers. A higher drainage efficiency is therefore available by increasing the length of louvers. However, to ensure compactness and reduced weight as in the case of the evaporator of the above publication, there is a need to decrease the spacing between adjacent heat exchange tubes. Lengthening the louvers is accordingly limited.

An object of the present invention is to overcome the above problems and to provide an evaporator wherein the fin surfaces can be drained of condensation water efficiently.

DISCLOSURE OF THE INVENTION

To fulfill the above object, the present invention comprises the following modes.

1) An evaporator comprising a plurality of flat heat exchange tubes arranged in a left-right direction at a spacing with the widthwise direction thereof pointing forward or rearward, and fins arranged between respective adjacent pairs of heat exchange tubes, the fins having at least front edges thereof projected forwardly outward beyond the heat exchange tubes.

2) An evaporator according to par. 1) wherein only the front edges of the fins are projected forwardly of the heat exchange tubes.

3) An evaporator according to par. 1) wherein assuming that the amount of projection of the fins beyond the heat exchange tubes is X mm and that the heat exchange tubes are Y mm in thickness in the left-right direction, i.e., in height, X and Y have the relationship of $0.11Y \leqq X \leqq 1.0Y$.

4) An evaporator according to par. 1) wherein assuming that the amount of projection of the fins beyond the heat exchange tubes is X mm and that the heat exchange tubes are Y mm in thickness in the left-right direction, i.e., in height, X and Y have the relationship of $0.3Y \leqq X \leqq 0.8Y$.

5) An evaporator according to par. 1) wherein at one side of the evaporator where the fins are projected, the heat exchange tubes each have an end face in the form of a segment of a cylindrical surface bulging outward at a midportion thereof with respect to the direction of height of the tube in cross section.

6) An evaporator according to par. 1) wherein at one side of the evaporator where the fins are projected, the heat exchange tubes each have a flat end face at a right angle with each of left and right opposite side surfaces of the tube.

7) An evaporator according to par. 6) wherein at one side of the evaporator where the fins are projected, the end face of the heat exchange tube has a rounded junction with each of the left and right opposite side surfaces thereof.

8) An evaporator according to par. 1) wherein each of the fins is in the form of a corrugated fin comprising a crest portion, a furrow portion and a connecting portion interconnecting the crest portion and the furrow portion, the connecting portion having a plurality of louvers arranged in parallel in the direction of passage of air, and the louver formed in an end portion of the fin adjacent to the projected edge thereof is positioned inwardly of an end of the heat exchange tube with respect to a front-rear direction at one side of the evaporator where the fins are projected.

9) An evaporator according to par. 8) wherein the louver positioned in the fin end portion adjacent to the projected edge is at a distance of up to 1 mm from the end of the heat exchange tube at the fin projected side.

10) An evaporator according to par. 8) wherein the fin is 7.0 mm to 10.0 mm in the straight distance between the crest portion and the furrow portion, i.e., in height, and 1.3 to 1.8 mm in the pitch of connecting portions, i.e., in pitch.

11) An evaporator according to par. 8) wherein the crest portion and the furrow portion of the corrugated fin each comprise a flat portion and a rounded portion provided at each of opposite sides of the flat portion and integral with the connecting portion, and the rounded portion has a radius of curvature of up to 0.7 mm.

12) An evaporator according to par. 1) wherein the heat exchange tubes are 0.75 to 1.5 mm in height, i.e., in thickness.

13) An evaporator according to par. 1) wherein the heat exchange tubes arranged in the left-right direction at a spacing are provided in groups in the form of a plurality of rows arranged in forward or rearward direction, and the fins arranged between the respective adjacent pairs of heat exchange tubes are each coextensive with the tube groups.

14) An evaporator according to par. 13) which comprises a refrigerant inlet header disposed on the front side of one end of each of the heat exchange tubes and having joined thereto the group of heat exchange tubes in the form of at least one row, a refrigerant outlet header disposed in the rear of the inlet header and positioned toward one end of each heat exchange tube, the outlet header having joined thereto the remaining heat exchange tubes, a first intermediate header disposed toward the other end of each heat exchange tube and having joined thereto the heat exchange tubes joined to the inlet header, and a second intermediate header disposed in the rear of the first intermediate header and positioned toward the other end of each heat exchange tube, the second intermediate header having joined thereto the heat exchange tubes joined to the outlet header, the two intermediate headers being held in communication with each other.

15) A refrigeration cycle comprising a compressor, condenser and an evaporator, the evaporator comprising a heat exchanger according to any one of pars. 1) to 14).

16) A vehicle having installed therein a refrigeration cycle according to par. 15) as a motor vehicle air conditioner.

With the evaporator according to any one of pars. 1), 2) and 5) to 7), at least one of the front and rear edges of each of the fins is projected forwardly or rearwardly outward beyond the heat exchange tube, so that a reentrant portion is formed between the projecting portion of the fin and the left or right side edge of the tube end adjacent to the fin. The condensation water produced on the surface of the fin flows as attracted to the reentrant portion by surface tension, and thereafter flows down along the reentrant portion and the end face of the heat exchange tube to fall. Accordingly, the fin surface can be drained of condensation water with an improved efficiency. The condensation water is therefore prevented from scattering or from freezing, whereby the impairment of heat exchange performance is precluded. Especially, the air flowing through the air passing clearance between each adjacent pair of heat exchange tubes causes the condensation water produced on the surface of the fin to smoothly flow downstream with respect to the direction of flow of the air, i.e., toward the front. The water can be discharged effectively in the case of the evaporator according to par. 2).

With the evaporator according to par. 3) or 4), the fin surfaces can be drained of condensation water with a reliably improved efficiency. The evaporator according to par. 4) can be drained of condensation water with a further improved efficiency.

In the evaporator according to par. 8), the louver formed in an end portion of the fin adjacent to the projected edge thereof is positioned inwardly of the end of the tube with respect to the front-rear direction at the fin projected side, with the result that the condensation water produced on the fin surface is smoothly attracted to the reentrant portion by surface tension to attain an improved drainage efficiency. Stated more specifically, the condensation water produced on the upper surface of each connecting portion of the corrugated fin flows through clearances between respective adjacent pairs of louvers, reaches the surface of the tube by way of the lower surface of the connecting portion and is smoothly attracted to the reentrant portion while flowing along the joint of the tube surface and the fin. If the louver positioned at the end portion of the fin adjacent to the projected edge thereof is positioned outwardly of the tube end with respect to the front-rear direction, condensation water is likely to remain on the louver.

The evaporator according to par. 9) exhibits the effect of evaporator 8) most remarkably.

With the evaporator according to par. 10), an increase in air passage resistance can be suppressed, while the heat exchange efficiency can be improved, with a good balance maintained therebetween.

With the evaporator according to par. 11), an increase in air passage resistance can be suppressed, while the heat exchange efficiency can be improved, with a good balance maintained therebetween.

BEST MODE OF CARRYING OUT THE INVENTION

Embodiments of the present invention will be described below with reference to the drawings.

Figure 1:
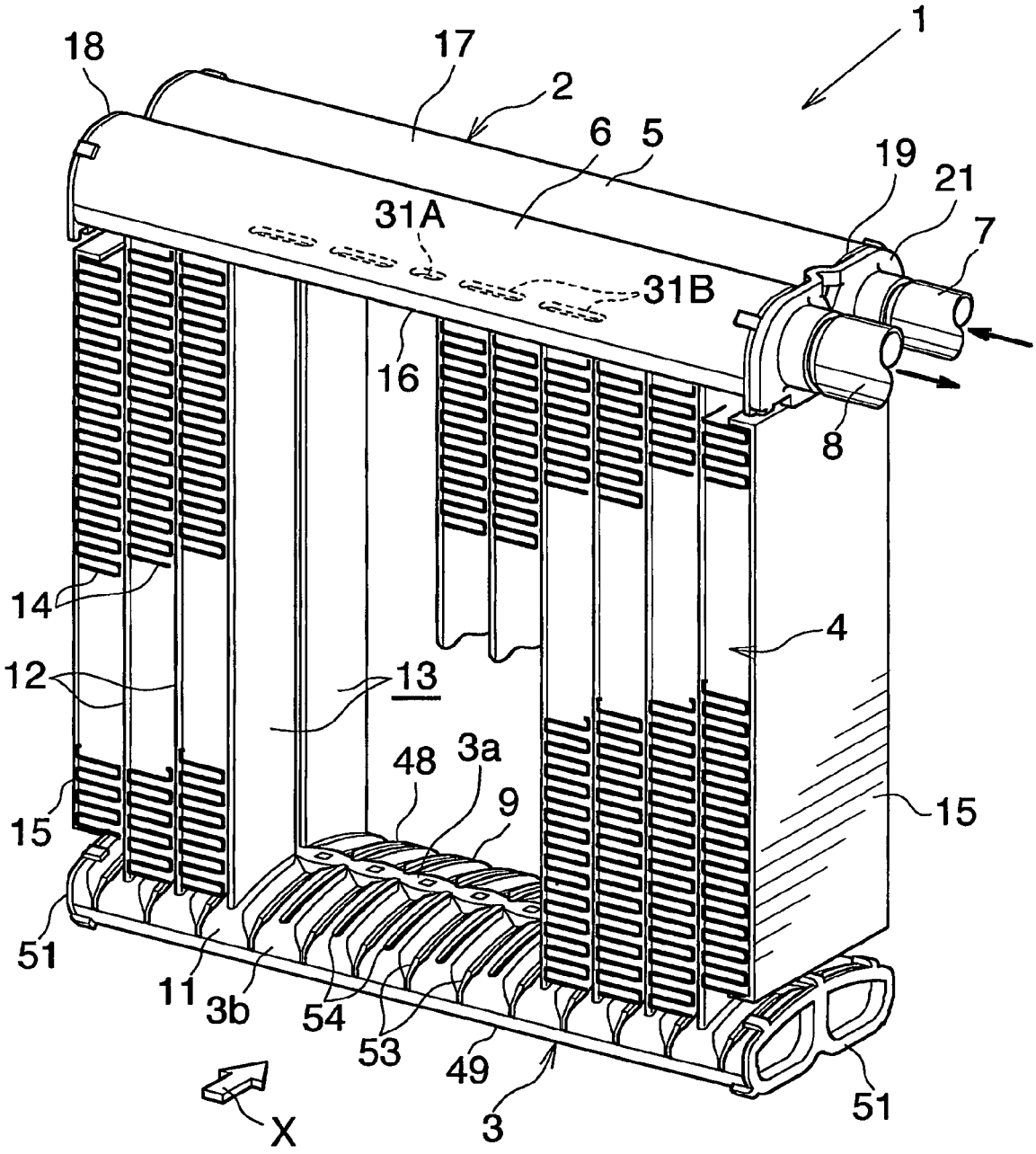
FIG. 1 is a perspective view partly broken away and showing the overall construction of an evaporator to which a heat exchanger of the invention is applied.
Figure 2:
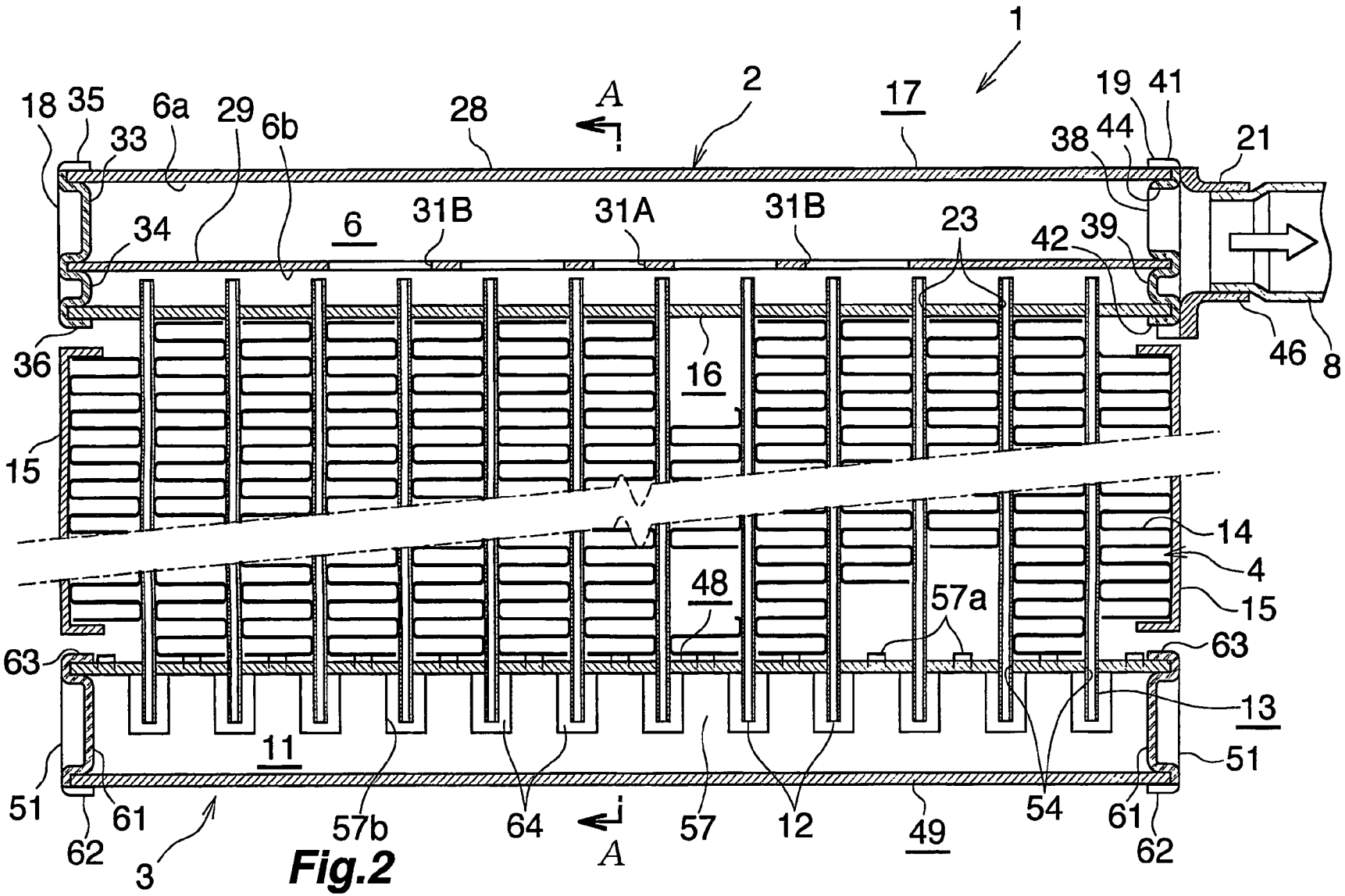
FIG. 2 is a view in vertical section and showing the evaporator of FIG. 1 as it is seen from behind, with an intermediate portion omitted.

FIGS. 1 and 2 show the overall construction of a motor vehicle air conditioner evaporator according to the invention, and FIGS. 3 to 8 show the constructions of main parts.

FIGS. 1 and 2 show an evaporator 1 for use in motor vehicle air conditioners wherein a chlorofluorocarbon refrigerant is used. The evaporator 1 comprises a refrigerant inlet-outlet tank 2 of aluminum and a refrigerant turn tank 3 of aluminum which are arranged one above the other at a spacing, and a heat exchange core 4 provided between the two tanks 2, 3.

The refrigerant inlet-outlet tank 2 comprises a refrigerant inlet header 5 positioned on the front side (the downstream side with respect to the direction of flow of air through the evaporator), and a refrigerant outlet header 6 positioned on the rear side (the upstream side with respect to the flow of air). A refrigerant inlet pipe 7 of aluminum is connected to the inlet header 5 of the tank 2, and a refrigerant outlet pipe 8 of aluminum to the outlet header 6 of the tank. The refrigerant turn tank 3 comprises a refrigerant inflow header 9 (first intermediate header) positioned on the front side, and a refrigerant outflow header 11 (second intermediate header) positioned on the rear side.

The heat exchange core 4 comprises tube groups 13 in the form of a plurality of rows, i.e., two rows in the present embodiment, as arranged in the front-rear direction, each tube group 13 comprising a plurality of heat exchange tubes 12 arranged in parallel in the left-right direction at a spacing. Corrugated fins 14 are arranged respectively in air passing clearances between respective adjacent pairs of heat exchange tubes 12 of each tube group 13 and also outside the heat exchange tubes 12 at the left and right opposite ends of each tube group 13, and are each brazed to the heat exchange tube 9 adjacent thereto. An aluminum side plate 15 is disposed outside the corrugated fin 14 at each of the left and right ends and brazed to the fin 14. The heat exchange tubes 12 of the front tube group 13 have upper and lower ends joined respectively to the inlet header 5 and the inflow header 9 to provide a forward refrigerant passage, and the heat exchange tubes 12 of the rear tube group 13 have upper and lower ends joined respectively to the outlet header 6 and the outflow header 11 to provide a refrigerant return passage. The inflow header 9, the outflow header 11 and all heat exchange tubes 12 constitute a refrigerant circulating passage for causing the inlet header 5 to communicate with the outlet header 6 therethrough.

Figure 3:
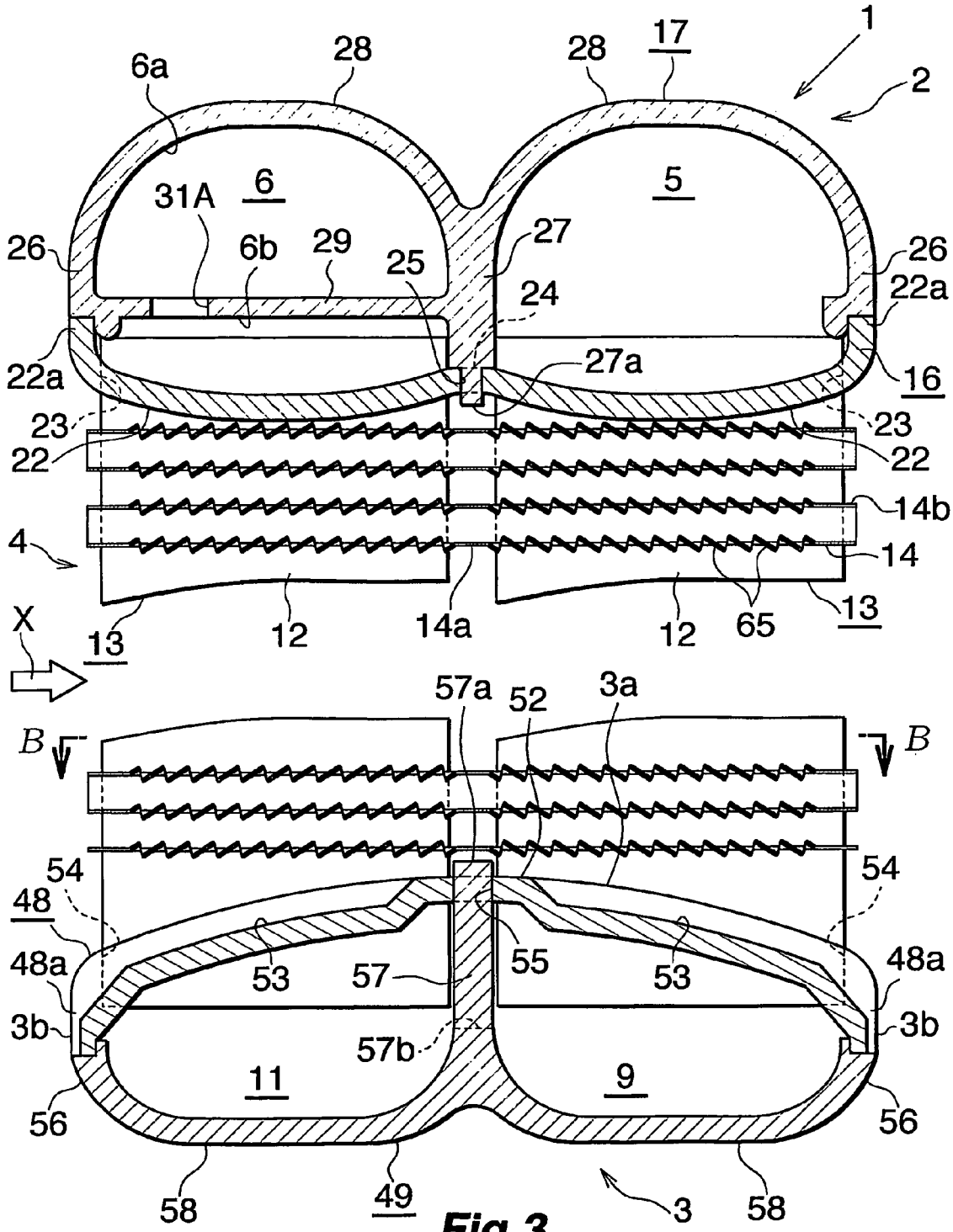
FIG. 3 is an enlarged fragmentary view in section taken along the line A-A in FIG. 2.
Figure 4:
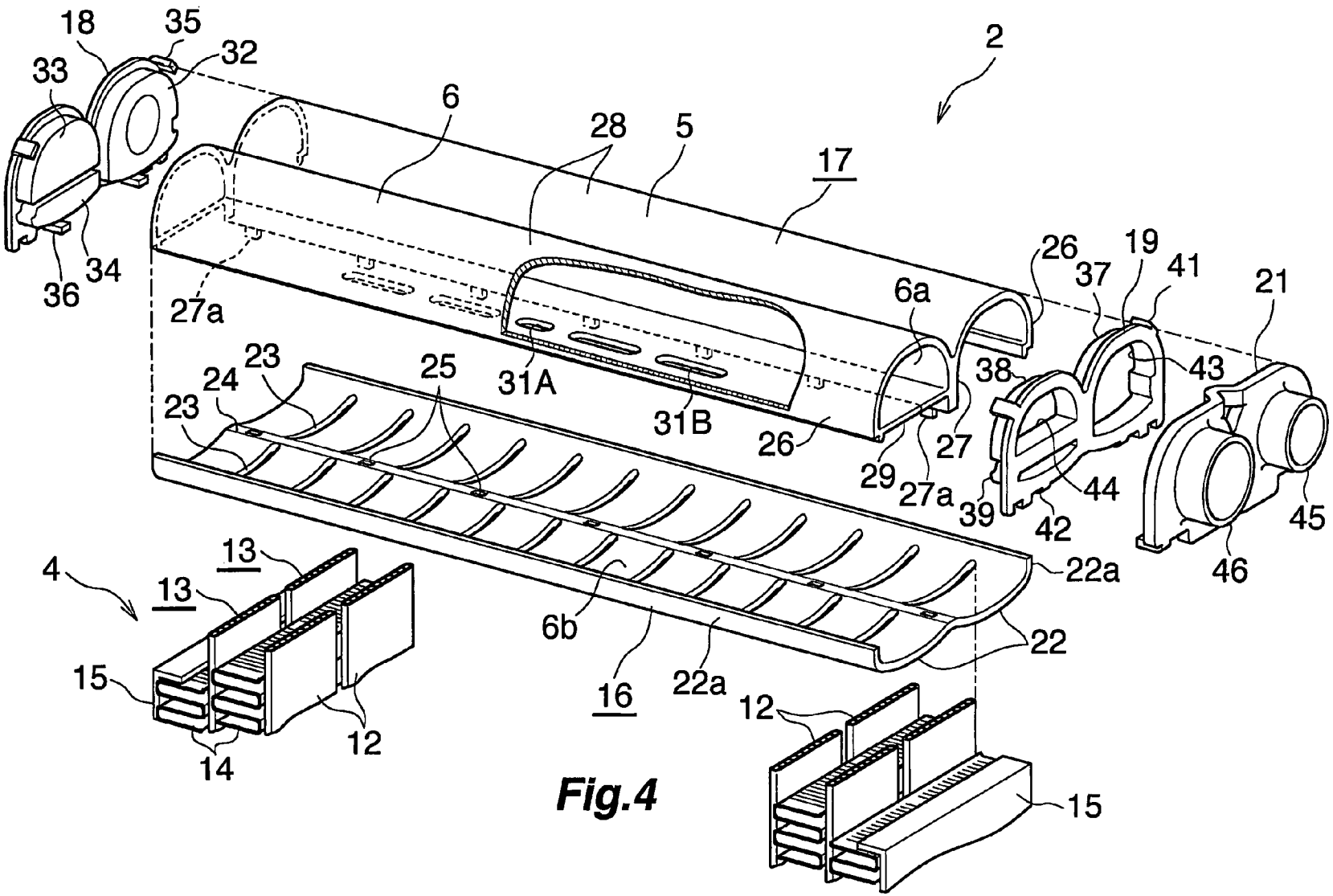
FIG. 4 is an exploded perspective view of a refrigerant inlet-outlet tank.

With reference to FIGS. 3 and 4, the refrigerant inlet-outlet tank 2 comprises a platelike first member 16 made of an aluminum brazing sheet having a brazing material layer over opposite surfaces thereof and having the heat exchange tubes 12 joined thereto, a second member 17 of bare aluminum extrudate and covering the upper side of the first member 16, and aluminum caps 18, 19 made of an aluminum brazing sheet having a brazing material layer over opposite surfaces thereof and joined to opposite ends of the two members 16, 17 for closing the respective opposite end openings. An aluminum joint plate 21 elongated in the front-rear direction is brazed to the outer surface of the cap 19 at the right end so as to cover both the inlet header 5 and the outlet header 6. The refrigerant inlet and outlet pipes 7, 8 are joined to the joint plate 21.

The first member 16 has at each of the front and rear side portions thereof a curved portion 22 in the form of a circular arc of small curvature in cross section and bulging downward at its midportion. The curved portion 22 has a plurality of tube insertion holes 23, i.e., slits 23, elongated in the front-rear direction and arranged at a spacing in the left-right, i.e., lateral, direction. Each corresponding pair of slits 23 in the front and rear curved portions 22 are in the same position with respect to the lateral direction. The front edge of the front curved portion 22 and the rear edge of the rear curved portion 22 are integrally provided with respective upstanding walls 22*a* extending over the entire length of the member 16. The first member 16 includes between the two curved portions 22 a flat portion 24 having a plurality of through holes 25 arranged at a spacing in the lateral direction.

The second member 17 is generally m-shaped in cross section and opened downward and comprises front and rear two walls 26 extending laterally, a partition wall 27 provided in the midportion between the two walls 26 and extending laterally as separating means for dividing the interior of the refrigerant inlet-outlet tank 2 into front and rear two spaces, and two generally circular-arc connecting walls 28 bulging upward and integrally connecting the partition wall 27 to the respective front and rear walls 26 at their upper ends. The rear wall 26 and the partition wall 27 are integrally interconnected at their lower ends over the entire length of the member 17 by a flow dividing resistance plate 29. The resistance plate 29 has refrigerant passing through holes 31A, 31B elongated laterally, formed therein at a rear portion thereof other than the left and right end portions of the plate and arranged at a spacing laterally thereof. The partition wall 27 has a lower end projecting downward beyond the lower ends of the front and rear walls 26 and is integrally provided with a plurality of projections 27*a* projecting downward from the lower edge of the wall 27, arranged at a spacing in the lateral direction and fitted into the through holes 25 of the first member 16. The projections 27*a* are formed by cutting away specified portions of the partition wall 27.

The left cap 18 is integrally provided, at its front portion, with a rightward protrusion 32 to be fitted into the inlet header 5. The cap 19 is integrally provided, at its rear portion, with an upper rightward protrusion 33 to be fitted into an upper space 6*a* of the outlet header 6 above the resistance plate 29 and with a lower rightward protrusion 34 positioned below and spaced apart from the protrusion 33 and to be fitted into a lower space 6*b* of the header 6 under the plate 29. The left cap 18 has an engaging lug 35 projecting rightward and formed integrally therewith on a circular-arc portion between its upper edge and each of the front and rear side edges thereof. The left cap 18 further has an engaging lug 36 projecting rightward and formed integrally therewith on each of front and rear portions of its lower edge. The right cap 19 is symmetric to the left cap 18. The right cap 19 has formed integrally therewith a leftward protrusion 37 fittable into the inlet header 5, an upper leftward protrusion 38 fittable into the upper space 6*a* of the outlet header 6 above the resistance plate 29, a lower leftward protrusion 39 fittable into the lower space 6*b* of the header 6 below the resistance plate 29, and upper and lower engaging lugs 41, 42. A refrigerant inlet 43 is formed in the bottom wall of the leftward protrusion 37 of the front portion of the right cap 19. A refrigerant outlet 44 is formed in the bottom wall of the upper leftward protrusion 38 of the rear portion of the right cap 19.

The joint plate 21 has integrally therewith a short cylindrical refrigerant inlet portion 45 communicating with the inlet 43 of the right cap 19, and a short cylindrical refrigerant outlet portion 46 communicating with the outlet 44 of the cap. The inlet portion 45 is slightly smaller than the outlet portion 46 in outside diameter. A constricted end portion of the refrigerant inlet pipe 7 is inserted into and brazed to the refrigerant inlet portion 45 of the joint plate 21, and a constricted end portion of the refrigerant outlet pipe 8 is inserted into and brazed to the outlet portion 46 of the same plate. Although not shown, an expansion valve mount member is joined to and positioned across the other end portions of the inlet pipe 7 and the outlet pipe 8.

The first and second members 16, 17 of the refrigerant inlet-outlet tank 2, the two caps 18, 19 and the joint plate 21 are brazed together in the following manner. The first and second members 16, 17 are brazed to each other utilizing the brazing material layer of the first member 16, with the projections 27*a* of the second member 17 inserted through the respective through holes 25 of the first member 16 in crimping engagement therewith and with the upper ends of the front and rear upstanding walls 22*a* of the first member 16 thereby engaged with the lower ends of the front and rear walls 26 of the second member 17. The two caps 18, 19 are brazed to the first and second members 16, 17 utilizing the brazing material layers of the caps 18, 19, with the protrusions 32, 37 of the front portions fitting in the front space inside the two members 16, 17 forwardly of the partition wall 27, with the upper protrusions 33, 38 of the rear portions fitting in the upper space inside the two members 16, 17 rearwardly of the partition wall 27 and above the resistance plate 29, with the lower protrusions 34, 39 of the rear portions fitting in the lower space rearwardly of the partition wall 27 and below the resistance plate 29, with the upper engaging lugs 35, 41 engaged with the connecting walls 28 of the second member 17, and with the lower engaging lugs 36, 42 engaged with the curved portions 22 of the first member 16. The joint plate 21 is brazed to the right cap 19 utilizing the brazing material layer of the cap 19. In this way, the refrigerant inlet-outlet tank 2 is made. The portion of the second member 17 forwardly of the partition wall 27 serves as the inlet header 2, and the portion of the member 17 rearward of the partition wall 27 as the outlet header 6. The outlet header 6 is divided by the flow dividing resistance plate 29 into upper and lower spaces 6*a*, 6*b*, which are held in communication by the refrigerant passing holes 31A, 31B. The refrigerant outlet 44 of the right cap 19 is in communication with the upper space 6*a* of the outlet header 6. The refrigerant inlet portion 45 of the joint plate 21 communicates with the refrigerant inlet 43, and the refrigerant outlet portion 46 thereof communicates with the outlet 44.

Figure 5:
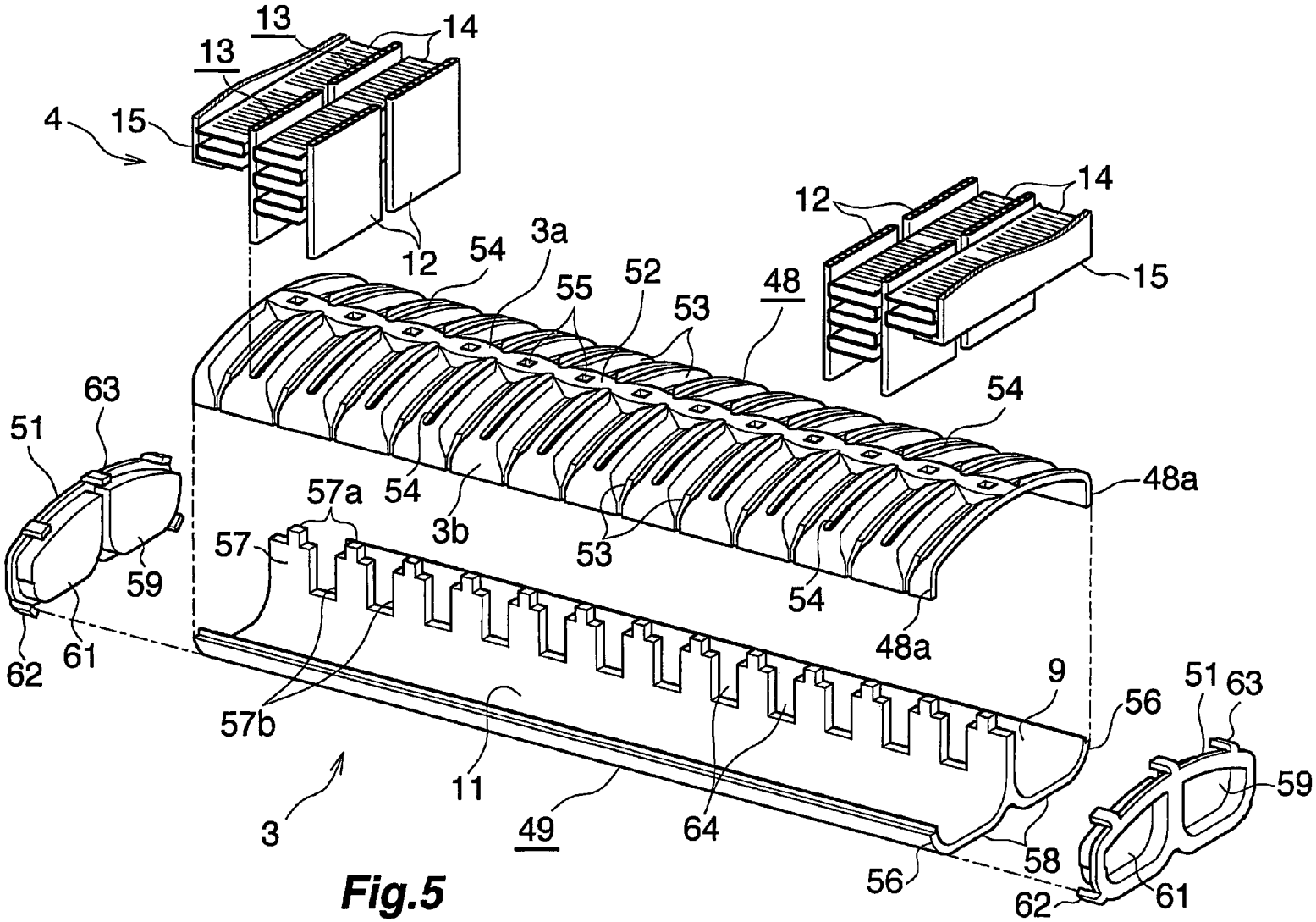
FIG. 5 is an exploded perspective view of a refrigerant turn tank.

With reference to FIG. 3 and FIG. 5, the refrigerant turn tank 3 comprises a platelike first member 48 made of aluminum brazing sheet having a brazing material layer over opposite surfaces thereof and having the heat exchange tubes 12 joined thereto, a second member 49 made of bare aluminum extrudate and covering the lower side of the first member 48, and aluminum caps 51 made of aluminum brazing sheet having a brazing material layer over opposite surfaces thereof for closing left and right opposite end openings.

The refrigerant turn tank 3 has a top surface 3*a* which is in the form of a circular-arc in cross section in its entirety such that the midportion thereof with respect to the front-rear direction is the highest portion 52 which is gradually lowered toward the front and rear sides. The tank 3 is provided in its front and rear opposite side portions with grooves 53 extending from the front and rear opposite sides of the highest portion 52 of the top surface 3*a* to front and rear opposite side surfaces 3*b*, respectively, and arranged laterally at a spacing.

The first member 48 has a circular-arc cross section bulging upward at its midportion with respect to the front-rear direction and is provided with a depending wall 48*a* formed at each of the front and rear side edges thereof integrally therewith and extending over the entire length of the member 48. The upper surface of the first member 48 serves as the top surface 3*a* of the refrigerant turn tank 3, and the outer surface of the depending wall 48*a* as the front or rear side surface 3*b* of the tank 3. The grooves 53 are formed in each of the front and rear side portions of the first member 48 and extend from the highest portion 52 in the midportion of the member 48 with respect to the front-rear direction to the lower end of the depending wall 48*a*. In each of the front and rear side portions of the first member 48 other than the highest portion 52 in the midportion thereof, tube insertion slits 54 elongated in the front-rear direction are formed between respective adjacent pairs of grooves 53. Each corresponding pair of front and rear tube insertion slits 54 are in the same position with respect to the lateral direction. The first member 48 has a plurality of through holes 55 formed in the highest portion 52 and arranged laterally at a spacing. The depending walls 48*a*, grooves 53, tube insertions slits 54 and through holes 55 of the first member 48 are formed at the same time by making the member 48 from an aluminum brazing sheet by press work.

The second member 49 is generally w-shaped in cross section and opened upward, and comprises front and rear two walls 56 curved upwardly outwardly forward and rearward, respectively, and extending laterally, a vertical partition wall 57, provided at the midportion between the two walls 56, extending laterally and serving as separating means for dividing the interior of the refrigerant turn tank 3 into front and rear two spaces, and two connecting walls 58 integrally connecting the partition wall 57 to the respective front and rear walls 56 at their lower ends. The partition wall 57 has an upper end projecting upward beyond the upper ends of the front and rear walls 56 and is provided with a plurality of projections 57*a* projecting upward from the upper edge thereof integrally therewith, arranged laterally at a spacing and fitted into the respective through holes 55 in the first member 48. The partition wall 57 is provided with refrigerant passing cutouts 57*b* formed in its upper edge between respective adjacent pairs of projections 57*a*. The projections 57*a* and the cutouts 57*b* are formed by cutting away specified portions of the partition wall 57.

The second member 49 is produced by extruding the front and rear walls 56, partition wall 57 and connecting walls 58 integrally, and cutting the partition wall 57 to form the projections 57*a* and cutouts 57*b*.

The front portion of each of the caps 51 has a laterally inward protrusion 59 formed on the laterally inner side thereof integrally therewith and fittable into the inflow header 9. The rear portion of the cap 51 has a laterally inward protrusion 82 formed on the laterally inner side thereof integrally therewith and fittable into the outflow header 11. Each cap 51 is integrally provided at a circular-arc portion between the lower edge thereof and each of the front and rear side edges thereof with an engaging lug 62 projecting laterally inward, and further has a plurality of engaging lugs 63 arranged at a spacing in the front-rear direction, formed on its upper edge integrally therewith and projecting laterally inward.

The first and second members 48, 49 of the turn tank 3 and the two caps 51 thereof are brazed together in the following manner. The first and second members 48, 49 are brazed to each other utilizing the brazing material layer of the first member 48, with the projections 57*a* of the second member 49 inserted through the respective holes 55 in crimping engagement and with the lower ends of front and rear depending walls 48*a* of the first member 48 in engagement with the upper ends of front and rear walls 56 of the second member 49. The two caps 51 are brazed to the first and second members 48, 49 using the brazing material layers of the caps 51, with the front protrusions 59 fitted in the space defined by the two members 48, 49 and positioned forwardly of the partition wall 57, with the rear protrusions 61 fitted in the space defined by the two members 48, 49 and positioned rearwardly of the partition wall 57, with the upper engaging lugs 63 engaged with the first member 48 and with the lower engaging lugs 62 engaged with the front and rear walls 56 of the second member 49. In this way, the refrigerant turn tank 3 is formed. The portion of the second member 49 forwardly of the partition wall 57 serves as the inflow header 9, and the portion thereof rearwardly of the partition wall 57 as the outflow header 11. The upper-end openings of the cutouts 57*b* in the partition wall 57 of the second member 49 are closed with the first member 48, whereby refrigerant passing holes 64 are formed.

Figure 6:
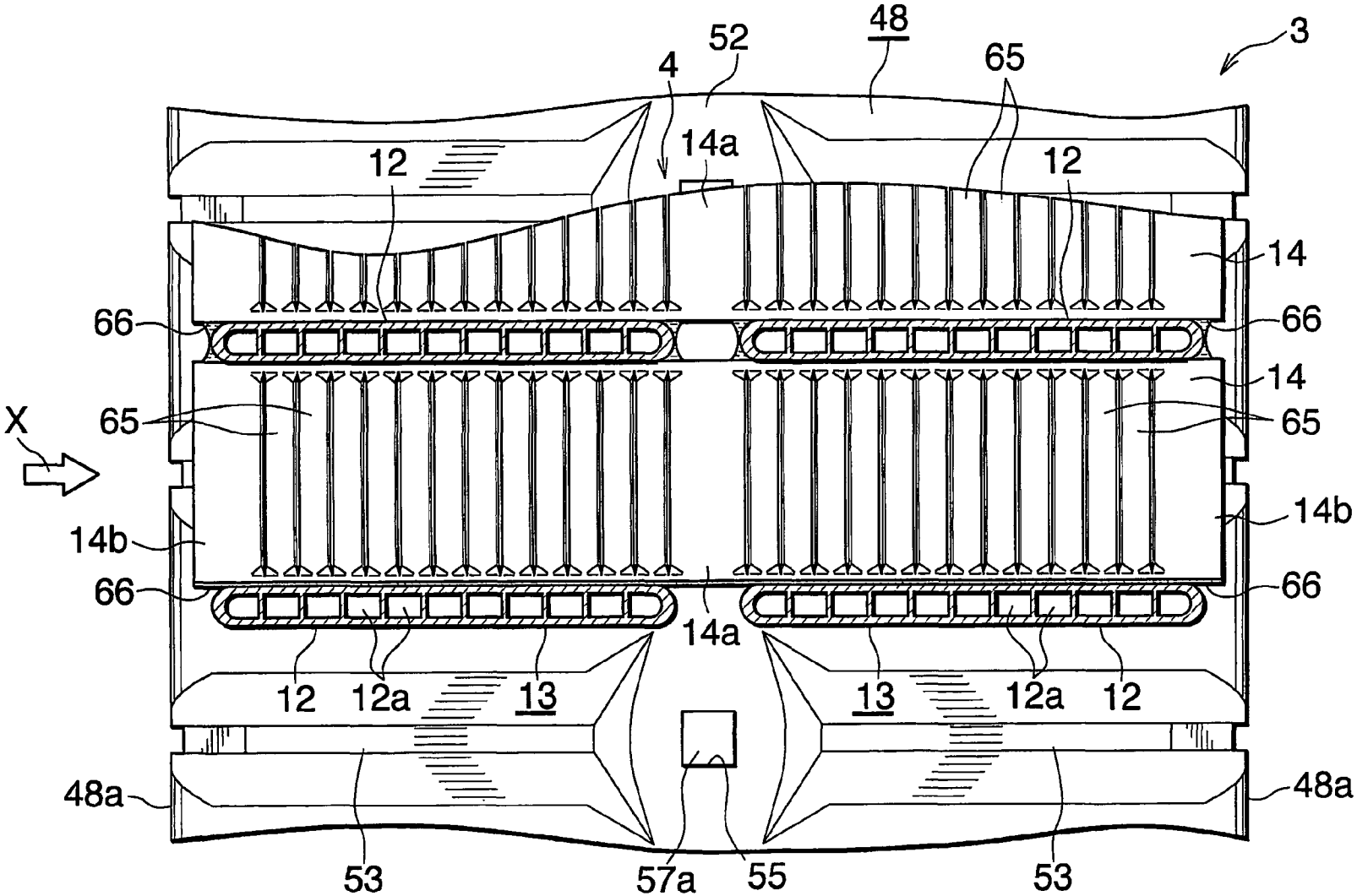
FIG. 6 is an enlarged view in section taken along the line B-B in FIG. 3.
Figure 7:
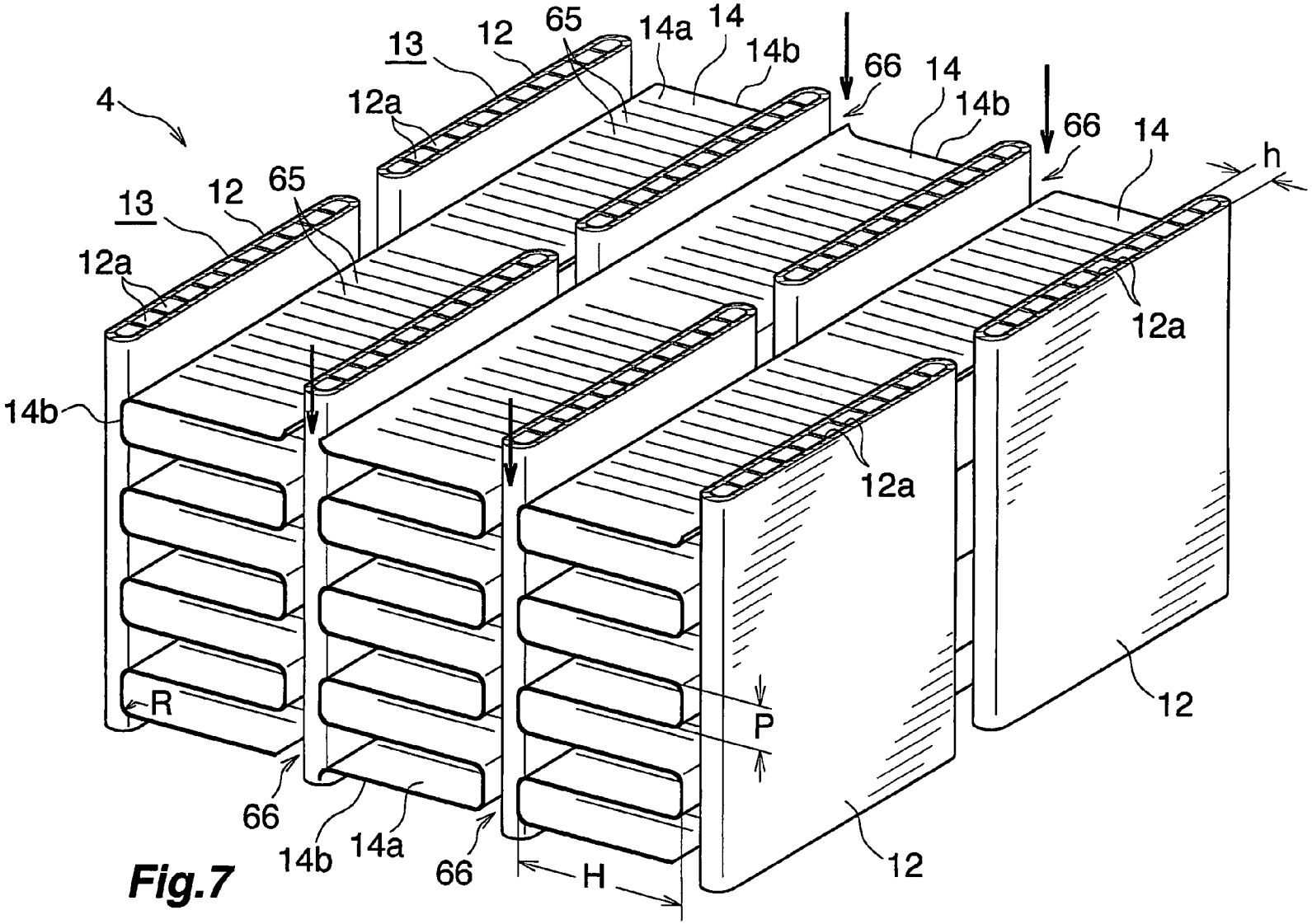
FIG. 7 is an enlarged perspective view showing a portion of a heat exchange core.

With reference to FIGS. 6 and 7, the heat exchange tubes 12 of the front and rear tube groups 13 are flat, made of aluminum extrudates and arranged laterally with their widthwise direction pointing toward the front or rear. Each of the tubes 12 is provided inside thereof with a plurality of refrigerant channels 12*a* arranged in parallel and extending longitudinally of the tube. The tube 12 has front and rear opposite end faces each of which, when seen in cross section, is in the form of a segment of a cylindrical surface bulging outward at its midportion with respect to lateral widthwise direction thereof, i.e., the direction of height of the tube. The heat exchange tubes 12 have upper end portions inserted through the slits 23 in the first member 16 of the refrigerant inlet-outlet tank 2 and are brazed to the first member 16 utilizing the brazing material layer of the member 16. The tubes 12 have lower end portions inserted through the slits 54 in the first member 48 of the refrigerant turn tank 3 and are brazed to the first member 48 utilizing the brazing material layer of the member 48.

Preferably, the heat exchange tube 12 is 0.75 to 1.5 mm in height h, i.e., in thickness in the lateral direction (see FIG. 7), 12 to 18 mm in width in the front-rear direction, 0.175 to 0.275 mm in the wall thickness of the peripheral wall thereof, 0.175 to 0.275 mm in the thickness of partition walls separating refrigerant channels 12*a* from one another, 0.5 to 3.0 mm in the pitch of partition walls, and 0.35 to 0.75 mm in the radius of curvature of the front and rear opposite end faces.

In place of the heat exchange tube 12 of aluminum extrudate, an electric resistance welded tube of aluminum may be used which has a plurality of refrigerant channels formed therein by inserting inner fins into the tube. Also usable is a tube which is made from a plate prepared from an aluminum brazing sheet having an aluminum brazing material layer on one surface thereof by rolling work and which comprises two flat wall forming portions joined by a connecting portion, a side wall forming portion formed on each flat wall forming portion integrally therewith and projecting from one side edge thereof opposite to the connecting portion, and a plurality of partition forming portions projecting from each flat wall forming portion integrally therewith and arranged at a spacing widthwise thereof, by bending the plate into the shape of a hairpin at the connecting portion and brazing the side wall forming portions to each other in butting relation to form partition walls by the partition forming portions.

The corrugated fin 14 is made from an aluminum brazing sheet having a brazing material layer on opposite sides thereof by shaping the sheet into a wavy form. The fin comprises crest portions, furrow portions and generally horizontal connecting portions 14*a* each interconnecting the crest portion and the furrow portion. The connecting portion 14*a* has a plurality of louvers 65 arranged in parallel at a spacing in the front-rear direction. The corrugated fins 14 are used in common for the front and rear tube groups 13. The corrugated fin 14 has a front edge projecting forward (forwardly outward) beyond the front end face of the heat exchange tube 12 of the front tube group 13 and a rear edge projecting rearward (rearwardly outward) beyond the rear end face of the heat exchange tube 12 of the rear tube group 13. These projecting portions are indicated at 14*b*. In this case, a reentrant portion 66 is formed between the front end face of the heat exchange tube 12 of the front tube group 13 and the forward projecting portion 14*b* of the corrugated fin 14, as well as between the rear end face of the heat exchange tube 12 of the rear tube group 13 and the rearward projecting portion 14*b* of the fin 14. The condensation water produced on the surface of the corrugated fin 14 flows as attracted to the reentrant portion 66 by surface tension and thereafter flows down along the reentrant portion 66 and along the surface of the tube 12. This drains the surface of the fin 14 of the condensation water with an improved efficiency, preventing the water from scattering, or from freezing to preclude the impairment of the heat exchange efficiency. By virtue of the air flowing through the air passing clearances between respective adjacent pairs of heat exchange tubes 12, the condensation water produced on the surfaces of the fins 14 smoothly flows downstream with respect to the direction of flow of the air, i.e., toward the front, so that only the front edges of the fins 14 project forward beyond the front end faces of the tubes 12 of the front group 13, and the rear edges of the fins 14 do not project rearward beyond the rear end faces of the tubes 12 of the rear group 13. For example, the fin rear edges may be positioned within the same vertical plane as the midportions, with respect to the left-right direction, of the rear end faces of the tubes 12. If the rear edges of the corrugated fins 14 are positioned forwardly of the rear end faces of the tubes 12 of the rear group 13, condensation water may possibly freeze on the surfaces of the tube portions where fins 14 are not positioned.

Figure 8:
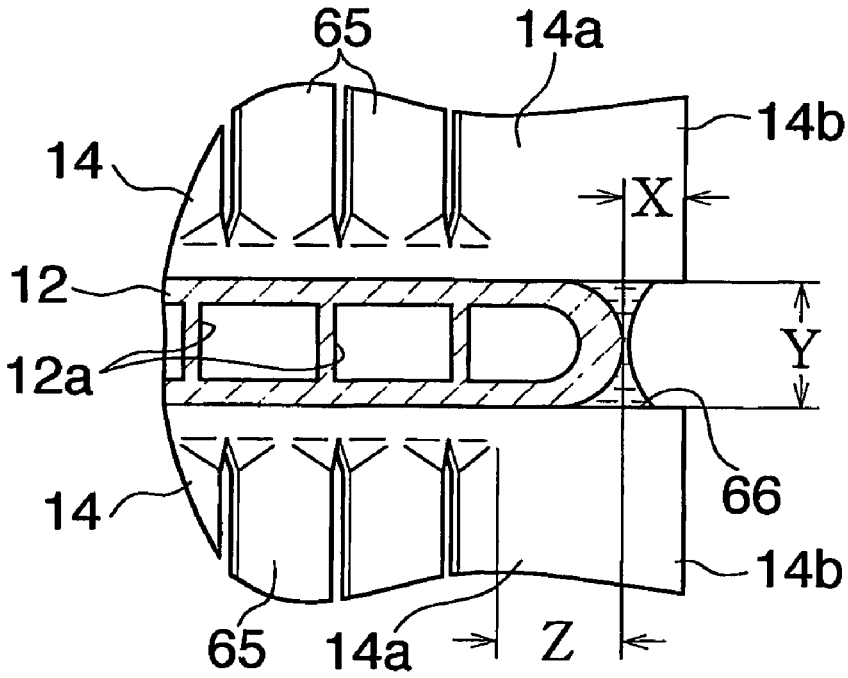
FIG. 8 is an enlarged fragmentary view of FIG. 6.

With reference to FIG. 8, it is assumed that the amount of projection of the corrugated fin 14 beyond the heat exchange tube 12 is X mm, and that the heat exchange tube 12 is Y mm in thickness in the left-right direction, i.e., in height. It is then desired that the amount of projection X and the tube height Y have the relationship of $0.11Y \leqq X \leqq 1.0Y$, more preferably $0.3Y \leqq X \leqq 0.8Y$. When $X \leqq 0.11Y$ and when $X > 1.0Y$, there is the likelihood that the surface of the corrugated fin 14 will not be drained of condensation water efficiently. The louver 65 positioned at the end of the fin 14 having the projecting portion 14*b* is positioned inwardly of the end face of the heat exchange tube 12 with respect to the front-rear direction, and the distance Z between the louver 65 and the end face of the tube 12 is preferably up to 1 mm.

It is desired that the corrugated fin 14 be 7.0 mm to 10.0 mm in fin height H which is the straight distance from the crest portion to the furrow portion, and 1.3 to 1.7 mm in fin pitch P which is the pitch of connecting portions 14*a*. While the crest portion and the furrow portion of the corrugated fin each comprise a flat portion brazed to the heat exchange tube 12 in intimate contact therewith, and a rounded portion provided at each of opposite sides of the flat portion and integral with the connecting portion 14*a*, the radius R of curvature of the rounded portion is preferably up to 0.7 mm (see FIG. 7). Instead of one corrugated fin serving for both the front and rear tube groups 13 in common, a corrugated fin may be provided between each adjacent pair of heat exchange tubes 12 of each tube group 13. In this case, at least the front edge of the corrugated fin 14 disposed between each adjacent pair of heat exchange tubes 12 in each tube group 13 is positioned as projected forwardly outwardly of the pair of tubes 12.

Figure 9:
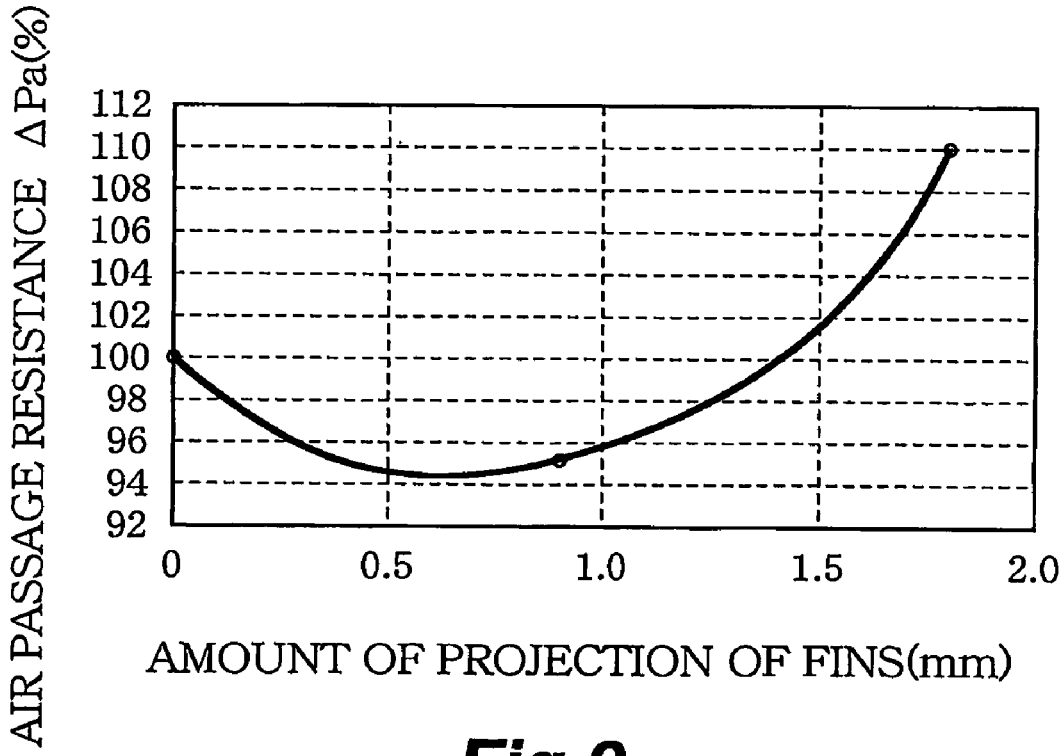
FIG. 9 is a graph showing the result of an experiment conducted to determine the relationship between the amount of projection X mm of corrugated fins beyond heat exchange tubes and the tube height Y mm which is the thickness in the left-right direction of the heat exchange tube.

The preferred relationship of $0.11Y \leqq X \leqq 1.0Y$ between the amount of projection X mm and the tube height Y mm is substantiated by the following experiment we conducted. The evaporator used had heat exchange tubes 12 measuring 1.4 mm in height h and 17 mm in width, and corrugated fins 14 measuring 8 mm in height H and 1.5 mm in pitch P. The evaporator was tested for resistance to passage of air therethrough while measuring the thermal performance by a method according to JIS D1618 to determine the relationship between the amount of projection of the corrugated fin 14 beyond the heat exchange tube 12 and the air passage resistance. Increased air passage resistance means inefficient discharge of condensation water produced on the surfaces of the fins 14. FIG. 9 shows the result. The graph of FIG. 9 shows the air passage resistance values in percentages relative to a reference value of resistance taken as 100% when the amount of projection is zero. The graph of FIG. 9 reveals that air passage resistance of not higher than 98%, that will result in efficient drainage, is available when the amount of projection is at least 0.154 mm to up to 1.4 mm. In this case, the fins are drained of condensation water to result in diminished air passage resistance. Since the tube height is 1.4 mm, we found that the air passage resistance is not higher than 98% when the amount of projection, X mm, of the corrugated fin 14 beyond the heat exchange tube 12 and the height of the heat exchange tube 12, Y mm, which is the thickness in the left-right direction, have the relationship of $0.11Y \leqq X \leqq 1.0Y$. The graph of FIG. 9 further reveals that the amount of projection X mm and the tube height Y mm more preferably have the relationship of $0.3Y \leqq X \leqq 0.8Y$. Thus, the amount of projection X is preferably around 0.5Y.

The evaporator 1 is fabricated by tacking the components, other than the refrigerant inlet pipe 7 and outlet pipe 8, in combination and brazing the tacked assembly collectively.

Along with a compressor and a condenser, the evaporator 1 constitutes a refrigeration cycle wherein a chlorofluorocarbon refrigerant is used. The cycle is installed in vehicles, for example, in motor vehicles for use as an air conditioner.

With the evaporator 1 described, a two-layer refrigerant of vapor-liquid mixture phase flowing through a compressor, condenser and expansion valve enters the refrigerant inlet header 5 of the inlet-outlet tank 2 via the refrigerant inlet pipe 7, the refrigerant inlet portion 45 of the joint plate 21 and the refrigerant inlet 43 of the right cap 19 and dividedly flows into the refrigerant channels 12*a* of all the heat exchange tubes 12 of the front tube group 13.

The refrigerant flowing into the channels 12*a* of all the heat exchange tubes 12 flows down the channels 12*a*, ingresses into the refrigerant inflow header 9 of the refrigerant turn tank 3. The refrigerant in the header 9 flows through the refrigerant passing holes 66 of the partition wall 59 into the refrigerant outflow header 11.

The refrigerant flowing into the outflow header 11 dividedly flows into the refrigerant channels 12*a* of all the heat exchange tubes 12 of the rear tube group 13, changes its course and passes upward through the channels 12*a* into the lower space 6*b* of the outlet header 6. The resistance offered by the flow dividing resistance plate 29 to the flow of refrigerant enables the refrigerant to uniformly flow from the outflow header 11 into all heat exchange tubes 12 of the rear tube group 13, also causing the refrigerant to flow from the inlet header 5 into all the tubes 12 of the front tube group 13 more uniformly. As a result, the refrigerant flows through all the heat exchange tubes 12 of the two tube groups 13 in uniform quantities.

Subsequently, the refrigerant flows through the refrigerant passing holes 31A, 31B of the resistance plate 29 into the upper space 6*a* of the outlet header 6 and flows out of the evaporator via the refrigerant outlet 44 of the right cap 19, the outlet portion 46 of the joint plate 21 and the outlet pipe 8. While flowing through the refrigerant channels 12*a* of the heat exchange tubes 12 of the front tube group 13 and the refrigerant channels 12*a* of the heat exchange tubes 12 of the rear tube group 13, the refrigerant is subjected to heat exchange with the air flowing through the air passing clearances in the direction of arrow X shown in FIG. 1 and flows out of the evaporator in a vapor phase.

At this time, water is produced on the surfaces of the corrugated fins 14 upon condensation. The condensation water flows as attracted to the reentrant portions 66 between the front end faces of the heat exchange tubes 12 of the front group 13 and the forward projecting portions 14*b* of the fins 14, and between the rear end faces of the heat exchange tubes 12 of the rear group 13 and the rearward projecting portions 14*b* of the fins 14 and thereafter flows down along the reentrant portions 66 and along the end faces of the tubes 12 onto the top surface 3*a* of the turn tank 3. The water on the tank top surface 3*a* enters the grooves 53 by virtue of a capillary effect, flows through the grooves 53 and falls to below the turn tank 3 from the forward and rearward ends of the grooves 53. In this way, a large amount of condensation water is prevented from collecting between the turn tank top surface 3*a* and the lower ends of the corrugated fins 14 and therefore from freezing, whereby the impairment of heat exchange performance is precluded.

Figure 10:
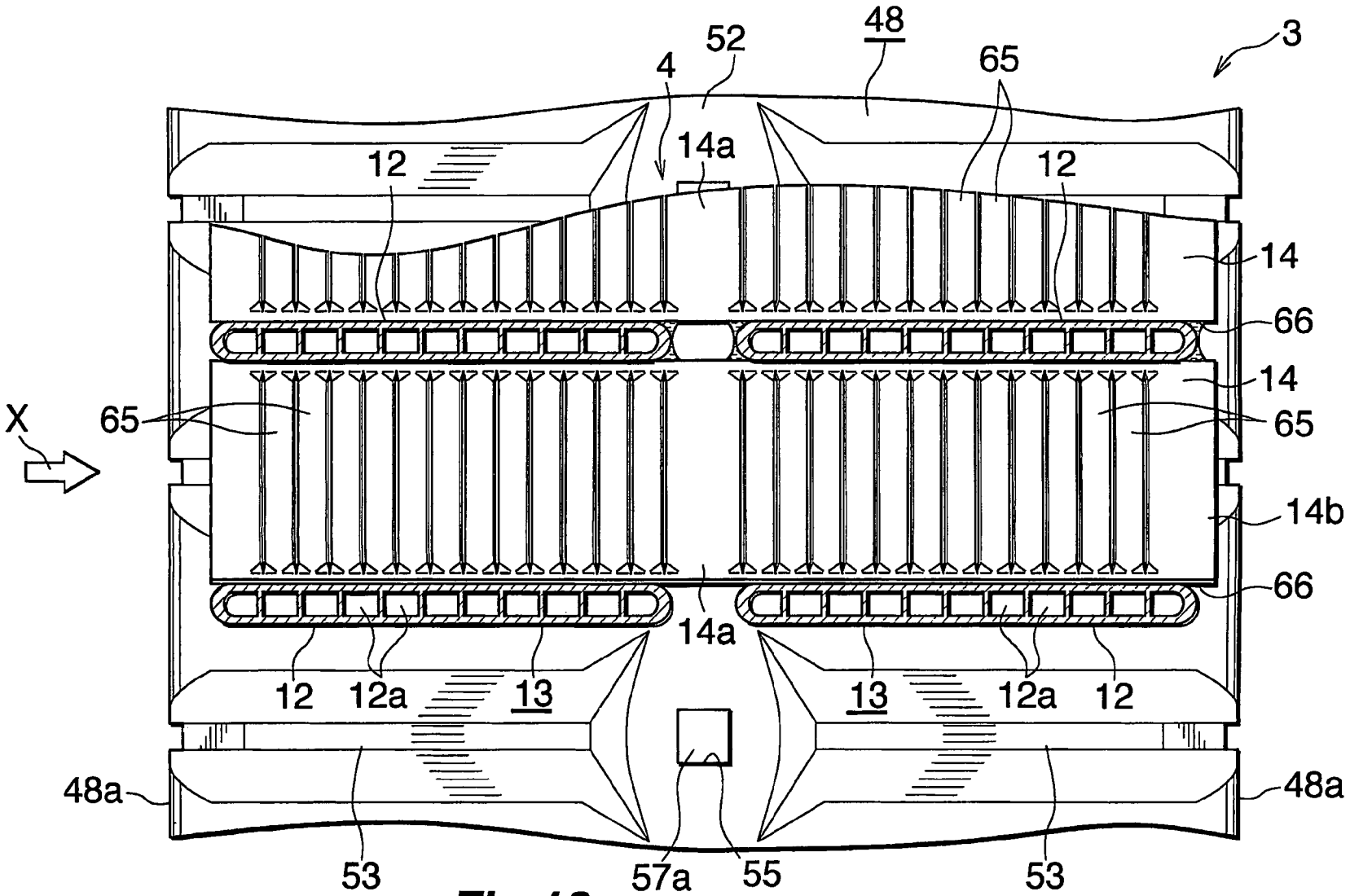
FIG. 10 is a view corresponding to FIG. 6 and showing another embodiment of evaporator according to the invention.

FIG. 10 shows another embodiment of evaporator.

In the case of the embodiment shown in FIG. 10, the rear edges of the corrugated fins 14 do not project rearward beyond the rear end faces of the heat exchange tubes 12 of the rear group 13 but are positioned within the same vertical plane as the midportions, with respect to the left-right direction, of the rear end faces of the tubes 12. The embodiment otherwise has the same-construction as the foregoing embodiment, and like parts are designated by like reference numerals. Since the rear end face of each heat exchange tube 12 is in the form of a segment of a cylindrical surface, the positioning of the rear edge of the fin 14 in the same vertical plane as the midportion, with respect to the left-right direction, of the rear end face of the tube 12 means that the portion of the rear end face of the tube 12 projecting to the rearmost position is positioned in the same vertical plane as the rear edge of the fin 14.

In the case of this embodiment, the air flowing through the air passing clearance between each adjacent pair of tubes 12 permits the condensation water produced on the surface of the fin 14 in the clearance to smoothly flow downstream with respect to the direction of flow of air, i.e., toward the front, so that the drainage efficiency will not be substantially influenced by the rear edge of the fin 14 which is not projecting rearward beyond the rear end faces of tubes 12 in the rear group 13 adjacent to the fin. However, if the rear edge of the fin 14 is positioned forwardly of the rear end faces of the tubes 12 in the rear group 13, condensation water is likely to freeze on the portions of the tubes 12 where the fin 14 is not positioned.

Figure 11:
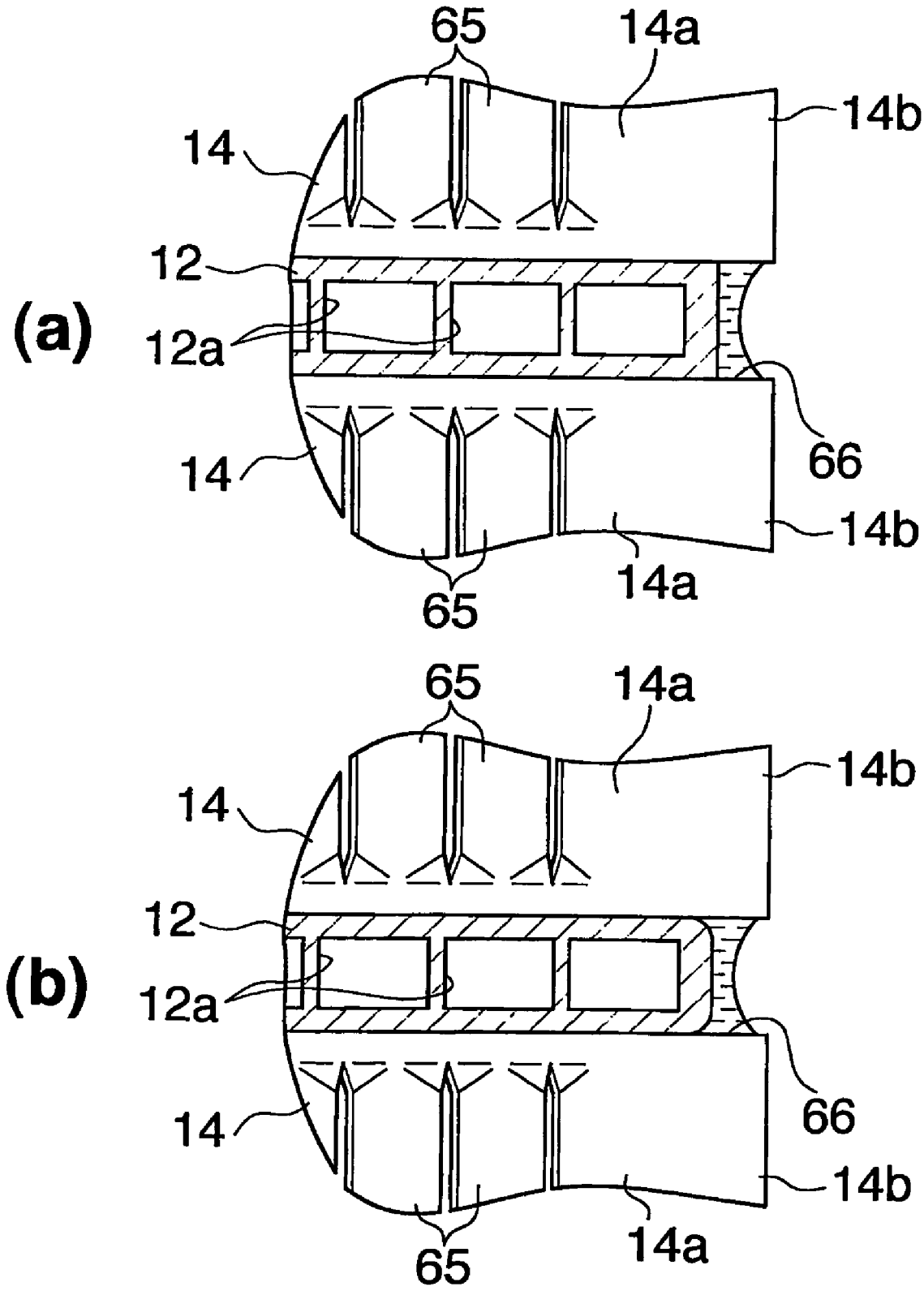
FIG. 11 includes views corresponding to FIG. 8 and showing modified heat exchange tubes.

FIG. 11 shows modified of heat exchange tubes.

In the case of the heat exchange tube 12 shown in FIG. 11(*a*), corrugated fins 14 have portions projecting beyond the respective front and rear end faces of the heat exchange tube 12 which are each in the form of a flat face at a right angle with each of the left and right opposite side surfaces of the tube.

In the case of the heat exchange tube 12 shown in FIG. 11(*b*), corrugated fins 14 have portions projecting beyond the respective front and rear end faces of the heat exchange tube 12 which are each in the form of a flat face, and the junctions of the flat face and the left and right side surfaces of the tube are rounded.

One group 13 of heat exchange tubes is provided between the inlet header 5 and the inflow header 9 of the two tanks 2, 3, as well as between the outlet header 6 and the outflow header 11 thereof according to the evaporators of two foregoing embodiments, whereas this arrangement is not limitative; one or at least two groups 13 of heat exchange tubes may be provided between the inlet header 5 and the inflow header 9 of the two tanks 2, 3, as well as between the outlet header 6 and the outflow header 11 thereof. The turn tank may be positioned alternatively below the inlet-outlet tank.

Further with the evaporators of the two embodiments described, the turn tank 3 is provided with grooves 53 arranged between respective adjacent pairs of heat exchange tubes 12 for achieving an improved drainage efficiency, whereas this arrangement is not limitative; grooves may be formed as positioned in corresponding relation with the respective heat exchange tubes 12 for attaining an improved draining efficiency. In this case, the turn tank 3 is provided in its top surface 3*a* to front and rear side surfaces 3*b* with grooves each made to extend from the forwardly or rearwardly outer end of each tube insertion slit 54 for draining the tank 3 with water with a higher efficiency.

The evaporator of the invention is used also in supercritical refrigeration cycles which comprise a compressor, gas cooler, evaporator, expansion valve serving as a pressure reducer, accumulator serving as a vapor-liquid separator, and intermediate heat exchanger for subjecting the refrigerant flowing out of the gas cooler and the refrigerant flowing out of the evaporator to heat exchange, and wherein $CO_2$ or like supercritical refrigerant is used, to serve as the evaporator of the cycle. Such a supercritical refrigeration cycle is installed in vehicles, for example, in motor vehicles, as an air conditioner.

INDUSTRIAL APPLICABILITY

The evaporator of the invention is suitable, for example, for use in motor vehicle air conditioners which are refrigeration cycles to be installed in motor vehicles.

The invention claimed is:

1. An evaporator comprising a plurality of vertical flat heat exchange tubes arranged in a left-right direction at a spacing with the widthwise direction thereof pointing along a direction of passage of air, and corrugated fins arranged between respective adjacent pairs of heat exchange tubes and comprising a crest portion, a furrow portion and a connecting portion interconnecting the crest portion and the furrow portion, the connecting portion having a plurality of louvers arranged in parallel with each other along the direction of passage of air, wherein:

the corrugated fins having leeward edges thereof projected outward in the leeward direction beyond a leeward end of the heat exchange tubes, all of said louvers are positioned in windward of the leeward end of the heat exchange tubes, and an end louver is positioned nearest to the leeward edge is at a distance of up to 1 mm from the leeward end of the heat exchange tubes.

2. An evaporator according to claim 1 wherein, assuming that the amount of projection of the fins beyond the heat exchange tubes is X mm and that the heat exchange tubes are Y mm in thickness in the left-right height direction, X and Y have the relationship of $0.11Y \leqq X \leqq 1.0Y$.

3. An evaporator according to claim 1 wherein, assuming that the amount of projection of the fins beyond the heat exchange tubes is X mm and that the heat exchange tubes are Y mm in thickness in the left-right height direction, X and Y have the relationship of $0.3Y \leqq X \leqq 0.8Y$.

4. An evaporator according to claim 1 wherein, at one side of the evaporator where the fins are projected, the heat exchange tubes each have an end face in the form of a segment of a cylindrical surface bulging outward at a midportion thereof with respect to a direction of height of the respective heat exchange tube in cross section.

5. An evaporator according to claim 1 wherein, at one side of the evaporator where the fins are projected, the heat exchange tubes each have a flat end face at a right angle with each of left and right opposite side surfaces of the respective heat exchange tube.

6. An evaporator according to claim 5 wherein, at one side of the evaporator where the fins are projected, an end face of the heat exchange tube has a rounded junction with each of the left and right opposite side surfaces thereof.

7. An evaporator according to claim 1 wherein the fin is 7.0 mm to 10.0 mm in the straight distance between the crest portion and the furrow portion, and 1.3 to 1.8 mm in the pitch of connecting portions.

8. An evaporator according to claim 1 wherein the crest portion and the furrow portion of the corrugated fin each comprise a flat portion and a rounded portion provided at each of opposite sides of the flat portion and integral with the connecting portion, and the rounded portion has a radius of curvature of up to 0.7 mm.

9. An evaporator according to claim 1 wherein the heat exchange tubes are 0.75 to 1.5 mm in height.

10. An evaporator according to claim 1 wherein the heat exchange tubes arranged in the left-right direction at a spacing are provided in groups in the form of a plurality of rows arranged along the direction of passage of air, and the fins arranged between the respective adjacent pairs of heat exchange tubes are each coextensive with the tube groups.

11. An evaporator according to claim 10, further comprising:

a refrigerant inlet header disposed on a leeward side of one end of each of the heat exchange tubes and having joined thereto the group of heat exchange tubes in the form of at least one row, a refrigerant outlet header disposed in the windward side of the inlet header and positioned toward one end of each heat exchange tube, the outlet header having joined thereto the remaining heat exchange tubes, a first intermediate header disposed toward the other end of each heat exchange tube and having joined thereto the heat exchange tubes joined to the inlet header, and a second intermediate header disposed in the windward side of the first intermediate header and positioned toward the other end of each heat exchange tube, the second intermediate header having joined thereto the heat exchange tubes joined to the outlet header, the two intermediate headers being held in communication with each other.

12. A refrigeration cycle comprising a compressor, condenser and an evaporator, the evaporator comprising an evaporator according to claim 1.

13. A vehicle having installed therein a refrigeration cycle according to claim 12 as a motor vehicle air conditioner.

* * * * *